US008714722B2

(12) United States Patent
Hays et al.

(10) Patent No.: US 8,714,722 B2
(45) Date of Patent: May 6, 2014

(54) MULTIPLE LAYER FILTER

(75) Inventors: Andrew W. Hays, Fairport, NY (US); Jun Ma, Penfield, NY (US); Peter J. Nystrom, Webster, NY (US); Bradley J. Gerner, Flagstaff, AZ (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/554,676

(22) Filed: Jul. 20, 2012

(65) Prior Publication Data

US 2014/0022320 A1 Jan. 23, 2014

(51) Int. Cl.
*B41J 2/175* (2006.01)

(52) U.S. Cl.
USPC ..... 347/93; 347/92; 210/799

(58) Field of Classification Search
USPC ..... 347/84, 92, 93, 20; 210/335, 252, 332, 210/488, 489, 498
See application file for complete search history.

(56) References Cited

U.S. PATENT DOCUMENTS 3,919,382 A * 11/1975 Smarook ..... 264/164
4,046,359 A * 9/1977 Gellert ..... 366/87
4,148,954 A * 4/1979 Smarook ..... 428/116
5,310,674 A * 5/1994 Weinreb et al. ..... 435/286.1
5,489,930 A * 2/1996 Anderson ..... 347/71
5,610,645 A * 3/1997 Moore et al. ..... 347/93
5,868,933 A * 2/1999 Patrick et al. ..... 210/484
7,484,835 B2 * 2/2009 Kim et al. ..... 347/67
7,901,064 B2 * 3/2011 Urayama et al. ..... 347/93
7,938,522 B2 * 5/2011 Xie et al. ..... 347/90
8,348,407 B2 * 1/2013 Matsufuji et al. ..... 347/93
8,419,175 B2 * 4/2013 Graham et al. ..... 347/93
2003/0026381 A1 * 2/2003 Ukai et al. ..... 376/446
2003/0080060 A1 * 5/2003 Gulvin ..... 210/650
2004/0026313 A1 * 2/2004 Arlon Fischer ..... 210/484
2004/0080592 A1 * 4/2004 Kneezel ..... 347/93
2004/0118770 A1 * 6/2004 Sale et al. ..... 210/488
2004/0251175 A1 * 12/2004 Adams et al. ..... 209/399
2005/0249917 A1 * 11/2005 Trentacosta et al. ..... 428/137
2006/0280906 A1 * 12/2006 Trentacosta et al. ..... 428/137
2009/0186190 A1 7/2009 Guan et al.
2010/0151190 A1 * 6/2010 Trentacosta et al. ..... 428/137
2010/0328409 A1 * 12/2010 Matsufuji et al. ..... 347/93
2011/0233152 A1 * 9/2011 Wieczorek et al. ..... 210/799

* cited by examiner

*Primary Examiner* — Matthew Luu
*Assistant Examiner* — Patrick King
(74) *Attorney, Agent, or Firm* — MH2 Technology Law Group LLP

(57) ABSTRACT

A structure and method including a filter assembly, wherein the structure can be an ink jet printhead including the filter assembly. The filter assembly can include a first filter layer having a plurality of pores therein, wherein the pores have a first pitch, and a second filter layer having a plurality of pores therein, wherein the pores in the second filter layer have a second pitch which is different than the first pitch. The structure can include a fluid path through the filter assembly. An area of overlap of the pores in the first filter layer with the pores in the second filter layer, in a vertical direction perpendicular to a plane of the filter assembly, can include a periodicity.

10 Claims, 7 Drawing Sheets

MULTIPLE LAYER FILTER

FIELD OF THE EMBODIMENTS

The present teachings relate to solid inkjet printing devices including printheads and a method for forming the printhead.

BACKGROUND OF THE EMBODIMENTS

Printing an image onto a print medium such as paper for consumer and industrial use is dominated generally by laser technology and ink jet technology. Ink jet technology has become more common as ink jet printing resolution and print quality has increased. Ink jet printers typically use either thermal ink jet technology or piezoelectric technology. Even though they are more expensive to manufacture than thermal ink jets, piezoelectric ink jets are generally favored as they can use a wider variety of inks.

Piezoelectric ink jet printheads typically include a flexible diaphragm manufactured from, for example, stainless steel. Piezoelectric ink jet printheads can also include an array of piezoelectric transducers (i.e., actuators) attached to the diaphragm. Other printhead structures can include one or more laser-patterned dielectric standoff layers and a flexible printed circuit (flex circuit) or printed circuit board (PCB) electrically coupled with each transducer. A printhead can further include a body plate, an inlet/outlet plate, and an aperture plate, each of which can be manufactured from stainless steel. The aperture plate includes a plurality of nozzles (i.e., one or more openings, apertures, or jets) through which ink is dispensed during printing. The number of nozzles per unit area generally determines the printer resolution, with higher resolution devices having more apertures within a given area. As printer resolution increases, the size of the nozzles and the quantity of ink in each ink drop dispensed onto a print medium decreases.

During use of a piezoelectric printhead, a voltage is applied to a piezoelectric transducer, typically through electrical connection with a flex circuit electrode electrically coupled to a voltage source, which causes the piezoelectric transducer to bend or deflect, resulting in a flexing of the diaphragm. Diaphragm flexing by the piezoelectric transducer increases pressure within an ink chamber and expels a quantity of ink from the chamber through a particular nozzle in the aperture plate. As the diaphragm returns to its relaxed (i.e., unflexed) position, it reduces pressure within the chamber and draws ink into the chamber from a main ink reservoir through an opening to replace the expelled ink.

During printhead manufacture, contaminants can be introduced into the printhead. These contaminants can be transported to the nozzle during printing where they can block the flow of ink through the nozzle and reduce print quality. To filter contaminants in the printhead, particulate filter or "rock screen" can be used. The particulate filter can include a stainless steel layer having a plurality of openings. The size of the openings determines the dimensions of the particulates which are blocked by the filter, and are typically sufficiently small to ensure filtration of contaminants which are large enough to block or plug the nozzle during ink jet during printing.

Printhead structures which can improve print quality and reduce printhead costs would be desirable.

SUMMARY OF THE EMBODIMENTS

The following presents a simplified summary in order to provide a basic understanding of some aspects of one or more embodiments of the present teachings. This summary is not an extensive overview, nor is it intended to identify key or critical elements of the present teachings nor to delineate the scope of the disclosure. Rather, its primary purpose is merely to present one or more concepts in simplified form as a prelude to the detailed description presented later.

In an embodiment of the present teachings, a structure can include a filter assembly. The filter assembly can include a first filter layer including a plurality of pores therein arranged in a pattern, wherein the plurality of pores in the first filter layer includes a first pore pitch, a second filter layer adjacent to the first filter layer and including a plurality of pores therein arranged in a pattern, wherein the plurality of pores in the second filter layer includes a second pore pitch which is different than the first pore pitch, and a fluid path through the filter assembly, wherein an area of overlap of the pores in the first filter layer with the pores in the second filter layer, in a vertical direction perpendicular to a plane of the filter assembly, includes a periodicity.

In another embodiment, a method for forming a structure which includes a filter assembly can include providing a first filter layer having a plurality of pores therein arranged in a pattern, wherein the plurality of pores in the first filter layer includes a first pore pitch and providing a second filter layer adjacent to the first filter layer which includes a plurality of pores therein arranged in a pattern, wherein the plurality of pores in the second filter layer has a second pore pitch which is different than the first pore pitch, placing the first filter layer adjacent to the second filter layer, and forming a fluid path through the filter assembly, wherein an area of overlap of the pores in the first filter layer with the pores in the second filter layer, in a vertical direction perpendicular to a plane of the filter assembly, has a periodicity.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

Figure 1:
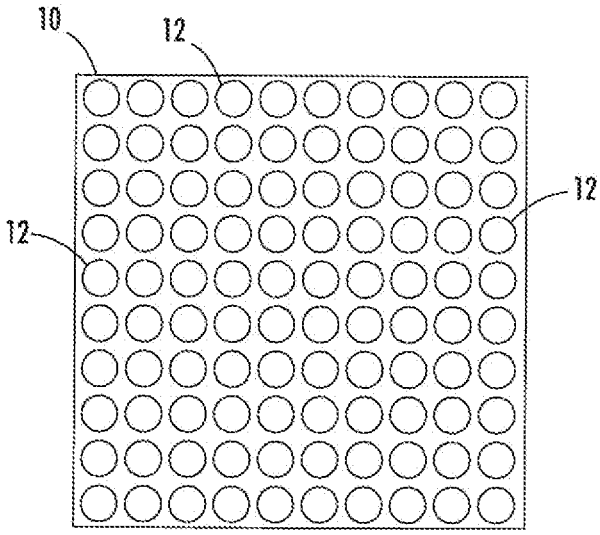
FIG. 1 is a plan view of a portion of a first filter layer including a plurality of pores with a first pitch.

It should be noted that some details of the FIGS. have been simplified and are drawn to facilitate understanding of the present teachings rather than to maintain strict structural accuracy, detail, and scale.

DESCRIPTION OF THE EMBODIMENTS

Reference will now be made in detail to the present embodiments (exemplary embodiments) of the present teachings, examples of which are illustrated in the accompanying drawings. Wherever possible, the same reference numbers will be used throughout the drawings to refer to the same or like parts.

As used herein unless otherwise specified, the word "printer" encompasses any apparatus that performs a print outputting function for any purpose, such as a digital copier, a bookmaking machine, a facsimile machine, a multi-function machine, a plotter, etc. As used herein unless otherwise specified, the terms "hole," "pore," and "opening" are used interchangeably. The term "pitch" as used herein is the distance between corresponding points on adjacent openings within a filter layer, or between adjacent actuators, in the X- and/or Y-directions.

As discussed above, contaminants within printer ink can block an ink jet aperture during printing which can reduce print quality or result in a nonfunctional ink jet. To reduce the effects of contamination, the ink path can of an ink jet printhead can include a particulate filter or "rock screen" which is used to filter contaminants from ink during printing. One type of conventional rock screen can include a single layer of material having openings or pores therethrough. The rock screen is located within the ink path to filter contaminants and prevent their delivery to the nozzle. While a single layer filter is generally effective at stopping particles whose smallest dimension exceeds the pore size of the rock screen, high aspect ratio particles that are sufficiently narrow to pass through the rock screen can re-orient in the flow to potentially block the downstream aperture, thereby causing quality defects. Additionally, during a purge cycle or another print cycle, the majority of debris that is stopped by the rock screen can backflow and be delivered to the rock screen in a new orientation, thereby increasing the opportunity for a given particle to orient in such a way that it can pass through the rock screen into the aperture.

A second type of conventional rock screen can include two layers of material each with the same pore pattern and pitch. The dual layers are separated by a space and aligned so that the pores are offset from each other so that the pores are misaligned. This misalignment of layers having pores of equal pitch increases the tortuosity of the ink path. With this dual layer filter, if a high aspect ratio particle aligns such that it passes through the first screen, the particle may be blocked by the second screen such that it is prevented from passing to the ink jet aperture. However, aligning these two layers of material such that they are perfectly misaligned within micron tolerances can be difficult, and any incorrect alignment decreases the efficiency of the filter.

An embodiment of the present teachings can reduce the possibility of narrow, high aspect ratio particles passing through a rock screen, and can relax processing complexity as alignment to within micron tolerances is not required. In an embodiment of the present teachings, two or more laminated filter layers may be used, where the each filter layer has a pore pattern and a pore pitch. The pore pitch of each filter layer can be different from the pitch of the other filter layers, and the pore pattern of each filter layer of each filter layer can be the same or different from the pore pattern of the other filter layers. In an embodiment, each layer is separated from the one or more other layers by a small gap.

Because the hole pitch of the two or more layers is different for each layer, there will be a spatial periodicity of overlapping holes across a distance of the filter layers. The spatial periodicity can include areas where holes are perfectly misaligned and have 0% overlap (which is an ideal filter region) and areas where holes are perfectly aligned and have 100% overlap (which is a non-ideal filter region). The rest of the filter area will have holes that are neither perfectly aligned nor perfectly misaligned, and which have various degrees of filtering effectiveness, with filtering efficiency being indirectly proportional to the amount of hole overlap. Areas where holes which are more misaligned in the vertical direction are more desirable and area where holes are more aligned in the vertical direction are less desirable.

In an embodiment, "ideal" regions and "non-ideal" regions can be based on the percentage of overlap between the areas of two or more holes in adjacent filter layers. The percentage of overlap which determines whether a hole alignment is ideal or non-ideal can be determined, for example, using an engineering analysis. For example, "ideal" regions may include regions where 75% or less of an area of a hole in a first filter layer overlaps a hole in an adjacent second filter layer in a vertical direction and "non-ideal" regions can include regions where more than 75% of the area of the hole in the first filter layer overlaps the hole in the adjacent second filter layer in the vertical direction. For purposes of this disclosure, the term "vertical" corresponds to a direction which is perpendicular to a major plane of the filter assembly, wherein the filter assembly includes two or more filter layers. In another embodiment, ideal regions may include regions where 50% or less of an area of a hole in a first filter layer overlaps a hole in an adjacent second filter layer in a vertical direction and non-ideal regions can include regions where more than 50% of the area of the hole in the first filter layer overlaps the hole in the adjacent second filter layer in the vertical direction. In another embodiment, ideal regions may include regions where 25% or less of an area of a hole in a first filter layer overlaps a hole in an adjacent second filter layer in a vertical direction and non-ideal regions can include regions where more than 25% of the area of the hole in the first filter layer overlaps the hole in the adjacent second filter layer in the vertical direction. Depending on the pitch and size of each opening, because of the spatial periodicity, a filter assembly can include holes which overlap in a range between 0% and 100%. Ideal and non-ideal regions can be set according to various factors, such as engineering requirements or preferences, design requirements or preferences, the average size and/or aspect ratio of particle contamination, etc.

Various methods described below may be used to reduce or eliminate the poor filtering effect of the non-ideal filter regions. More particularly, the non-ideal regions, which can include regions where the holes are perfectly aligned and regions which are adjacent thereto where the holes are almost perfectly vertically aligned (or aligned within a defined percentage of hole overlap), may be effectively removed from the ink flow path using one of the techniques and/or structures described below.

FIG. 1 is a plan view depicting a portion of a first filter layer 10 having a plurality of pores, openings, or holes 12 therein. In this embodiment, the portion of the first filter layer 10 depicted in FIG. 1 includes a 10×10 grid of evenly spaced openings across an arbitrary area, or 100 openings, and a first pitch between openings. The filter layers described herein can be fabricated from a polymer layer such as polyimide or a metal layer such as stainless steel, and the openings can be formed using, for example, laser ablation, punching, etching, photo-chemical processes, or other techniques. In an exemplary embodiment, each opening 12 can have a diameter of about 15 μm, with a hole pitch of about 25 μm.

Figure 2:
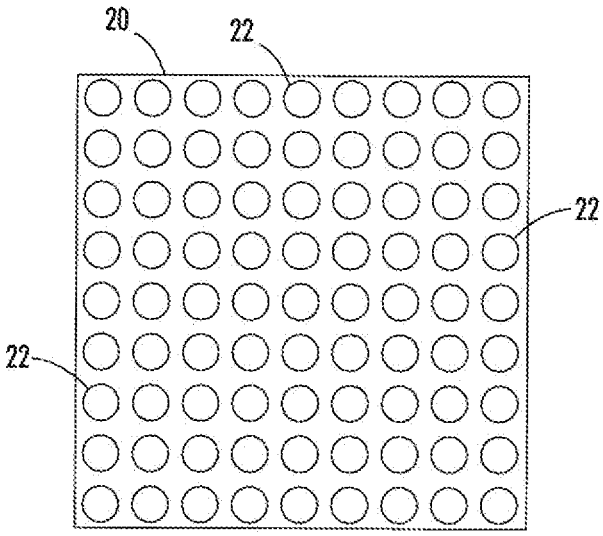
FIG. 2 is a plan view of a portion of a second filter layer including a plurality of pores with a second pitch which is different than the first pitch.

FIG. 2 is a plan view depicting a portion of a second filter layer 20 having a plurality of pores, openings, or holes 22 therein. In this embodiment, the portion of the second filter layer 20 depicted in FIG. 2 includes a 9×9 grid of evenly spaced openings across the arbitrary area, or 81 openings, and a second pitch between openings that is different than the first pitch. In this exemplary embodiment, each opening 22 can have a diameter of about 15 μm, with a hole pitch of about 28 μm. It will be understood that FIGS. 1 and 2 depict only a portion of the first filter layer 10 and second filter layer 20 respectively.

Figure 3:
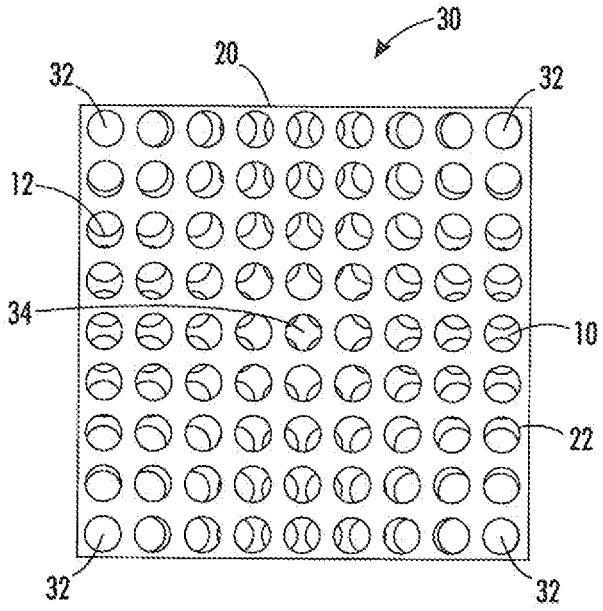
FIG. 3 is a semi-transparent plan view of a portion of a filter assembly including the first filter layer and the second filter layer.

After forming the two filter layers 10, 20, they can be physically connected together using, for example, one of the processes and/or structures described later in this document, or otherwise placed adjacent to each other. FIG. 3 is a plan view depicting a filter assembly 30 which includes the two filter layers 10, 20. In an embodiment, the two filters 10, 20 are connected together with no attempt to align or misalign the layers 10, 20 or pores 12, 22 with each other.

Because the hole pitch is different in each filter layer 10, 20, there is a spatial periodicity of the hole alignment. Some pores in the filter layers can be, by chance, perfectly aligned (non-ideal) as depicted at 32 and some holes can be perfectly misaligned (ideal) as depicted at 34. In an embodiment, the filter assembly 30 can be assembled along with other components to fabricate an ink jet printhead, with the filter assembly 30 being placed in an ink flow path within the printhead. The effectiveness of the FIG. 3 filter assembly 30 at screening high aspect ratio contamination will vary at different regions of the filter assembly 30. Locations 34 where the holes 12, 22 are perfectly misaligned in a vertical direction will typically provide the most efficient filtering, while locations 32 where the holes 12, 22 are perfectly aligned in a vertical direction will typically provide the least efficient filtering. Holes 12, 22 which are aligned somewhere between these two extremes will provide varying levels of filtering, depending on the degree of misalignment, with efficiency being indirectly proportional to hole overlap.

Thus in contrast to some conventional dual layer filters, a filter assembly 30 formed in accordance with an embodiment of the present teachings is provided without a requirement of an accurate placement of the two layers relative to each other within micron tolerances. The spatial periodicity of the vertical overlap in the areas of the pores provided when the two filter layers are placed adjacent to each other will depend on the pitch of the openings of each layer.

Figure 4:
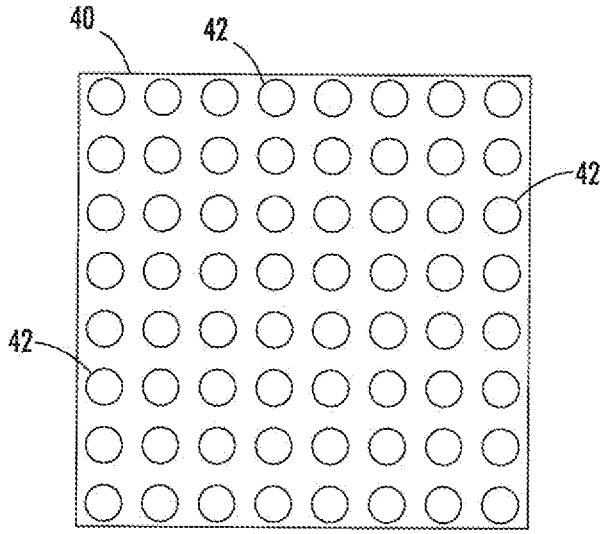
FIG. 4 is a plan view of a portion of a third filter layer including a plurality of pores with a third pitch which is different than the first and second pitches.

To increase filter efficiency, additional filter layers can be added to the two layer embodiment. If additional layers are added, each filter layer in the filter assembly can have pores with a different hole pitch from every other filter layer. For example, FIG. 4 is a plan view depicting a portion of a third filter layer 40 having a plurality of pores, openings, or holes 42 therein. In this embodiment, the portion of the second filter layer 40 depicted in FIG. 4 includes a 8×8 grid of evenly spaced openings across the arbitrary area, or 64 openings. In this exemplary embodiment, each opening 42 can have a diameter of about 15 μm, with a hole pitch of about 32 μm. It will be understood that FIG. 4 depicts only a portion of the third filter layer 40, and the pattern depicted in FIG. 4 can be repeated across the entire filter layer. Thus the layers 10, 20, and 40 are three filter layers each having a hole pitch that differs from every other filter layer.

Figure 5:
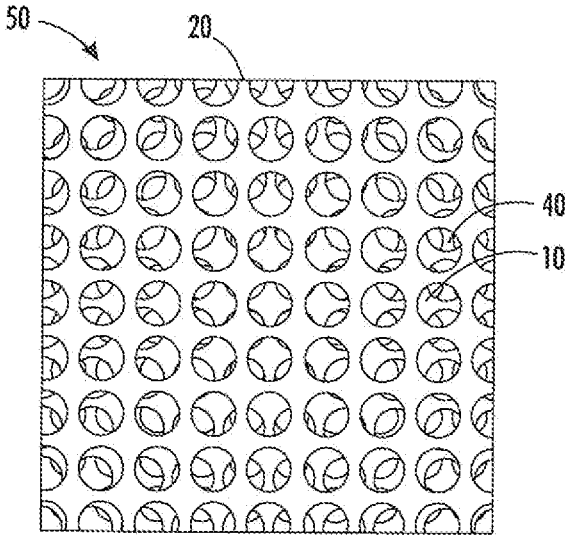
FIG. 5 is a semi-transparent plan view of a portion of a filter assembly including the first filter layer, the second filter layer, and the third filter layer.

After completing the third filter layer 40, the third filter layer 40 can be attached or otherwise positioned adjacent to the filter assembly 30 of FIG. 3 to result in the three layer filter assembly 50 of FIG. 5. In FIG. 5, the three filter layers have been arbitrarily assembled and, by chance, demonstrates the case of an ideal three-layer misalignment where the top two layers are misaligned in the middle and the bottom two layers are misaligned in the corners. Such an ideal misalignment of layers yields good overall misalignment and filtering for the entire unit area.

Figure 6:
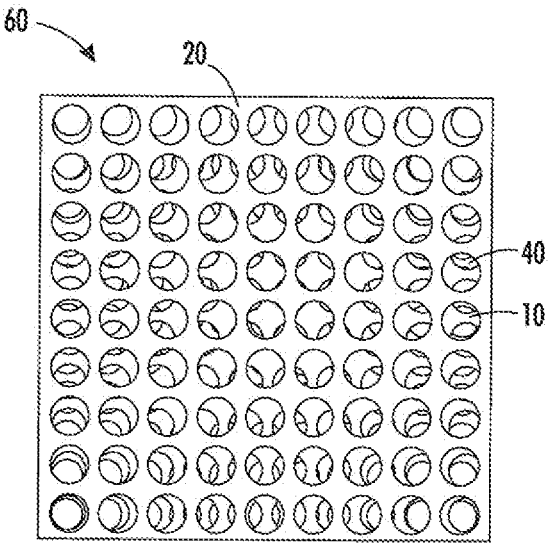
FIG. 6 is a semi-transparent plan view of a portion of a filter assembly including the first filter layer, the second filter layer, and the third filter layer which, by chance, is aligned differently than the FIG. 5 depiction.

FIG. 6 depicts the same three layers as FIG. 5 but, by chance, the three filter layers 10, 20, 40 have been aligned differently. In this embodiment, various pores for each layer are generally aligned to varying degrees in the four corners such that the holes have a large percentage of overlap. As the number of filter layers increases, with each filter layer having a different hole pitch, the probability of hole alignment decreases. With a three layer assembly 50, 60 as depicted in FIGS. 5 and 6, an actual filter assembly will, by chance, typically lie somewhere between the ideal misalignment of FIG. 5 and the worst case non-ideal alignment of FIG. 6.

In an embodiment, regardless of the number of layers used, any non-ideal aligned holes can be detected using an optical illumination technique. For example, the FIG. 7 structure 70 includes first regions 72 where holes within the plural layers are generally aligned with a large percentage of hole overlap (i.e., regions where hole alignment configuration is less desirable) and second regions 74 where holes within the plural layers are generally misaligned with a low percentage of hole overlap (i.e., regions where hole alignment configuration is more desirable). The first regions 72 and second regions 74 will generally be repeated in the X- and Y-axis of the FIG. 7 structure resulting from the periodicity of the alignment overlap of the holes through each filter layer.

Figure 7:
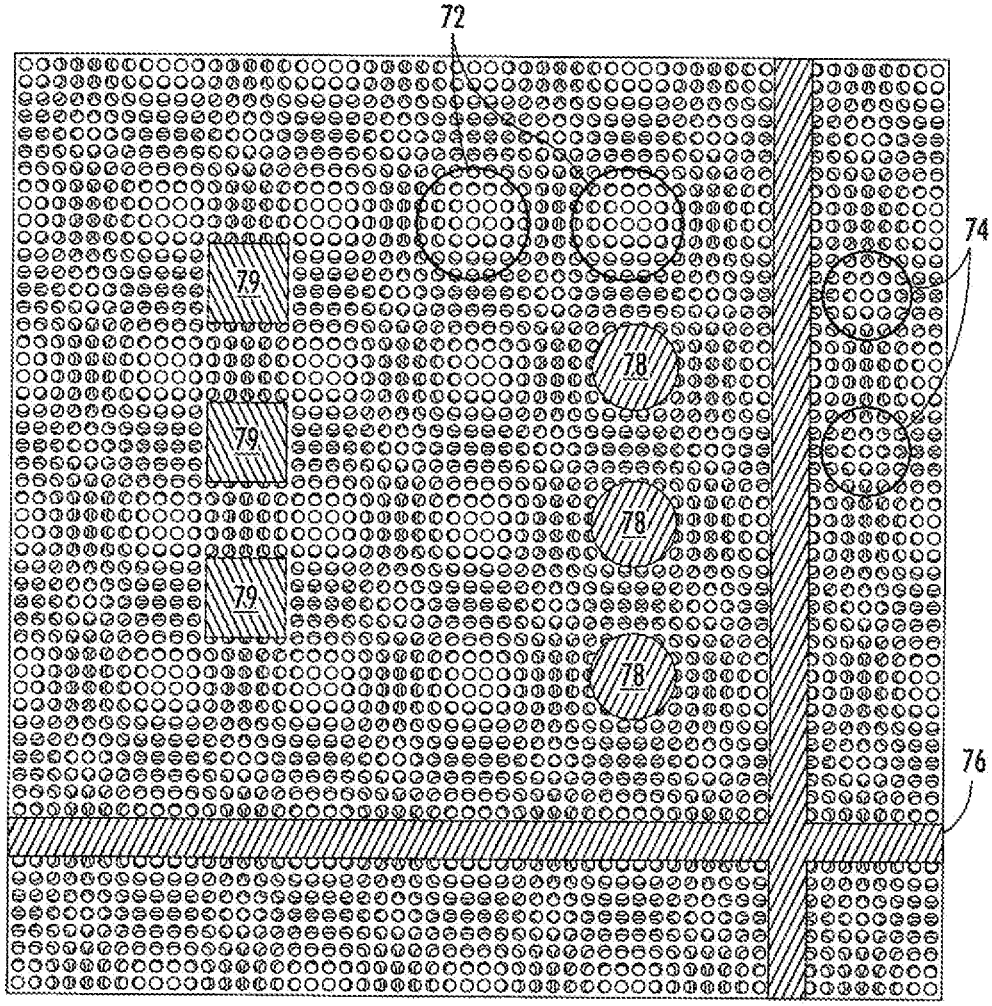
FIG. 7 is a semi-transparent plan view of a portion of filter assembly including different fluid path elimination structures.

After all the filter layers have been attached together into a filter assembly 70, each filter assembly 70 can be optically tested. For example, a light source can be used to illuminate a filter assembly from a first side and the light intensity which passes through the filter in a given area can be detected from the second side to determine the ideal and non-ideal regions. Because the two or more layers have different hole pitches to provide overlapping holes with a repeating periodicity, the pattern of ideal and non-ideal regions will repeat across the filter. The pattern of light which passes through the filter assembly 70 can be analyzed or inspected to determine whether the filter assembly 70 includes any non-ideal regions or areas 72 where holes generally align. If the filter assembly includes only ideal regions, the filter assembly can be passed for assembly with other printhead structures to form a printhead. If the filter assembly includes non-ideal areas 72, the filter assembly can be processed to eliminate the fluid path in the non-ideal areas 72 where the holes are aligned, which can improve filtering efficiency. Three different fluid path elimination structures and/or techniques according to embodiments of the present teachings are depicted in FIG. 7 and described below, although other fluid path elimination structures and techniques may become apparent to those of ordinary skill in the art. It will be understood that each fluid path elimination technique can be repeated across each region 72.

A first fluid path elimination structure can include an exposed patterned photosensitive layer 76 which is interposed between each of the two or more filter layers which are placed adjacent to each other. The photosensitive layer 76 can adhere the filter layers to each other and block the less desirable, non-ideal regions 72 where the holes generally align. One process to form this patterned photosensitive layer is depicted in FIGS. 8 and 9.

Figure 8:
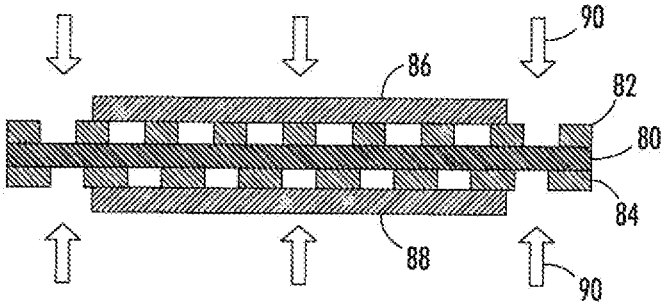
FIGS. 8-12 are cross sections depicting intermediate structures resulting from various processes to form fluid path elimination structures.

In an exemplary embodiment as depicted in FIG. 8, an unexposed photosensitive layer 80 can be interposed between a first filter layer 82 having eight openings in the area depicted and a second filter layer 84 having seven openings in the area depicted. The unexposed photosensitive layer 80 can include a photosensitive adhesive sheet, for example DuPont™ Riston® or Vacrel® dry film photoresist, which is interposed between layers 82, 84. The unexposed photosensitive layer 80 may also include a liquid material such as Benzocyclobuten (BCB) or MicroChem SU-8 which is spun onto one of the layers 82, 84 and then the other layer 82, 84 is applied to the liquid material, wherein layer 80 is used to adhere layers 82, 84 together. Other variations are also contemplated, for example in which a liquid unexposed photoresist is injected, impregnated, or molded into one or both filter layers 82, 84 then processed using similar techniques as described below.

While the photosensitive layer 80 used in this exemplary embodiment is a negative resist, it will be understood that a positive resist process can be performed. In this embodiment, unexposed photosensitive layer 80 physically attaches first filter layer 82 and second filter layer 84 together. The regions at the left and right sides of FIG. 8 have been measured and determined to include regions 72 which are non-ideal, which can be based on a maximum allowable percentage of overlap of the areas of the two or more holes when measured in a vertical direction. In other words, the area of hole overlap in these regions between the first filter layer 82 and the second filter layer 84 exceeds an arbitrary engineering tolerance, for example as determined through optical analysis, and are regarded as filter assembly regions to be excluded from filtering. In this embodiment, an opaque patterned first mask 86 is attached to, or provided over, the first filter layer 82 and an opaque patterned second mask 88 is attached to, or provided over, the second filter layer 84. Portions of the photosensitive sheet 80 which are uncovered by the first mask 86 and the second mask 88 are exposed to a light source 90 in accordance with known photoimaging techniques to expose the portions of the photosensitive sheet 80 which are not covered by masks 86, 88.

Figure 9:
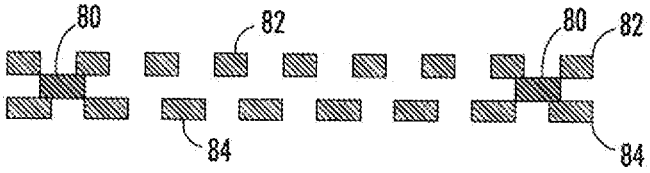

Next, the masks 86, 88 are removed and the photosensitive sheet 80 is exposed to a developer to remove the unexposed portions and to form a structure similar to that depicted in FIG. 9. The remaining portions of the photosensitive sheet 80 attach the first 82 and second 84 filter layers together and block the filtering of the aligned openings, thereby removing the non-ideal regions from the ink path. Photosensitive sheet 80 may provide a blocking structure similar to structure 76 depicted in FIG. 7.

Another fluid path elimination structure can be formed by melting one or more filter layers in the regions where the pores are aligned in a non-ideal arrangement. Melting of one or both filter layers can be performed, for example, using a laser beam output by a laser, or by other techniques. For example, FIG. 10 depicts a first filter layer 100 and a second filter layer 102 which are attached using an adhesive layer 104 interposed therebetween.

In this embodiment, the adhesive layer 104 can be formed as a solid sheet which is interposed between the filter layers 100, 102, which is then etched from both sides of the filter assembly using an anisotropic vertical etch. During a first etch in a first direction, the first filter layer 100 functions as a first etch mask and, during a second etch from a second direction, the second filter functions as a second etch mask to block the etch such that a portion of the adhesive layer 104 remains between the filter layers 100, 102 as depicted in FIG. 10.

Figure 10:
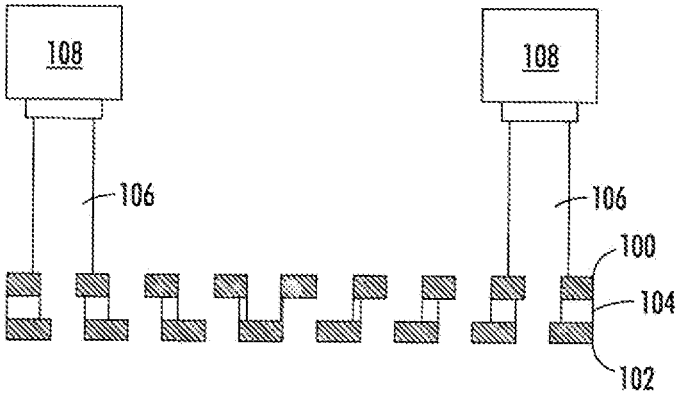
Figure 11:
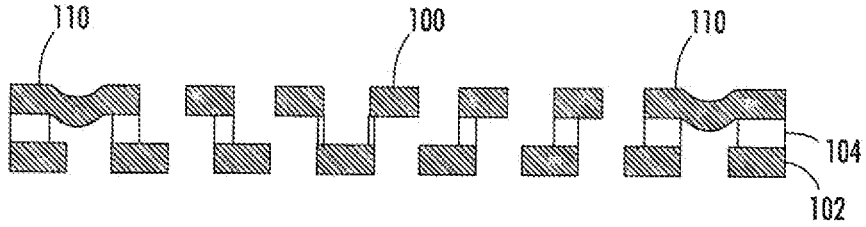

The regions at the left and right sides of FIG. 10 have been measured and determined to include less desirable non-ideal regions 72. In other words, the area of hole overlap in these regions between the first filter layer 100 and the second filter layer 102 exceeds an arbitrary engineering tolerance, for example as determined through optical analysis, and are regarded as filter regions to be excluded from filtering. In these regions, a laser beam 106 output by a laser 108 is focused onto at least one of the filter layers 100, 102, for example the first filter layer 100, which melts the first filter layer 100 to result in the melted portions 110 depicted in FIG. 11. Melting portions of the filter layer 100 blocks the flow of ink through the non-ideal regions where the holes are aligned to have an overlap which exceeds specifications, and removes these portions from the ink flow path.

Figure 12:
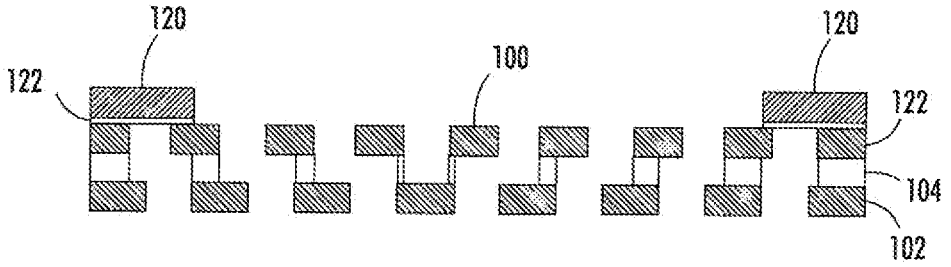

Another fluid path elimination technique can include the formation of a patterned blocking layer 78 attached to a surface of one or more of the filter layers as depicted in FIG. 7. The blocking layer 78 is located over areas which have been measured and determined to include regions 72 which have aligned holes and a low filtering efficiency. In an embodiment, blocking layer 78 can be screen printed or deposited using a masked or unmasked spray technique. In another embodiment as depicted in FIG. 12, a blocking layer can also include a layer 120, for example a polymer layer, attached to a surface of a filter layer 100, for example using an adhesive 122.

Yet another fluid path elimination technique can be implemented when the filter assembly is fabricated together with other structures such as ink jet actuators 79 (FIG. 7) that are distributed at a pitch which is greater than or equal to the periodicity of regions 72, for example a positive integer multiple of the periodicity of regions 72. The periodicity of the openings of the filter assembly can be set by configuring two or more filter layers to have hole pitches which vary from each other by a specific amount to set the filter assembly periodicity. By designing a filter assembly that has a spatial periodicity for regions 72 that is the same or higher than the pitch of the actuators 79, for example a positive integer multiple thereof, the location of regions 72 can be optically identified and the actuators 79 can be placed directly over the non-ideal regions 72 to "hide" or bury non-ideal regions 72 outside the main flow path of the ink. While alignment tolerances of the pores through multiple filter layers themselves would be in the micron range, the alignment of which is avoided with an embodiment of the present teachings, the alignment of the actuators 79 to regions 72 is on the order of 10's of microns and thus results in a simplified process. If the pitch of the actuators is greater than the pitch of the filter opening periodicity, for example if the actuator periodicity is an integer multiple of the filter periodicity where the integer is 2 or greater, one of the other fluid path elimination structures described herein can be used to remove the non-ideal locations which are not covered by the actuators 79 from the ink flow path.

In an embodiment, a pitch of the openings in each filter layer can vary in the X- and Y-directions. For example, the pores can have a density of eight per unit area in the X-direction and a density of ten per unit area in the Y-direction. Having different pitches in different directions may be advantageous when the pitch of the actuators 79 themselves is different in the X- and Y-directions. The filter layers can be aligned so that their X- and Y-directions are aligned, which minimizes rotational misalignment.

Additionally, angled (parallelogram) shaped unit cells of filter holes can be realized by shifting each row of holes in each layer laterally. This may be advantageous when the actuators of the actuator array are not aligned in the X- and Y-directions in a rectangular grid pattern, but are offset with respect to each other so that the array is tilted. In such a design, forming angled shaped unit cells of filter holes would allow the actuator array to be aligned with the ideal regions of the filter assembly. The actuators can be placed over the ideal regions so that the non-ideal regions can be buried or hidden.

Figure 13:
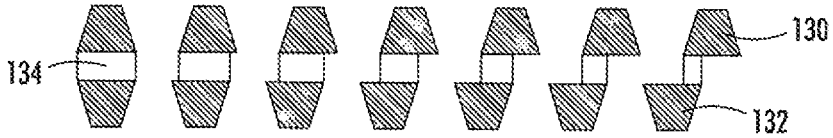
FIG. 13 is a cross section depicting a filter assembly according to another embodiment of the present teachings.

It is contemplated that the pores through the filter layers can be shapes other than round, for example square, rectangular, oval, etc. FIG. 13 depicts an embodiment in which the pores through a first filter 130 and a second filter 132 are square or rectangular and have tapered sidewalls. The holes can be tapered, for example, with a taper angle of between about 4° and about 10°, for example about 7°. A tapered opening results in an opening having a first hole opening at a first surface of the filter layer which is larger than a second hole opening at a second surface of the filter layer. A difference in hole size between the first opening and the second opening, from one side of a filter layer to the other side, may be about six microns for a 25 μm thick filter layer. When dual filter layers are oriented so that the smaller openings of each filter are oriented toward each other as depicted in FIG. 13, particulate filtering of the filter assembly is improved as the net size of the opening between two filter layers with different pore pitches is decreased.

Thus an embodiment of the present teachings can include a filter assembly having two or more filter layers with non-equal hole pitches. If the hole spatial frequency of a first filter layer is $f_1$ and the hole spatial frequency of a second filter layer is $f_2$, then the frequency of the hole alignment between the two layers will be $\Delta f = abs(f_2 - f_1)$ and the spatial periodicity of the hole alignment in the filter assembly will be $1/\Delta f$. If the two layers are then placed together without regard to alignment in the X- and Y-directions (i.e., they are arbitrarily aligned relative to each other, minimizing rotational misalignment) with a gap in between, then there will be regions where the holes are perfectly aligned (non-ideal) and regions where the holes are perfectly misaligned (ideal). For the purposes of this discussion, misaligned holes provide better particle blocking than aligned holes.

Embodiments of the present teachings can include the fabrication and use of a filtering medium which does not require a process to precisely align the layers relative to each other as is the case for dual filter layers that have equal hole pitches. Precise alignment of two or more layers of material with equal hole pitches so that the holes can be perfectly misaligned, as is the case for dual layer equal pitch filters, is much more difficult than placing the two or more layers together without regard to precise alignment. After the filter layers are placed together, the result can be analyzed and processing can continue based on the orientation of the two filter layers with respect to each other. The holes within each filter layer may be formed by laser ablation, punching, etching, photo-chemical processes or any other means used to form small holes. Additionally, embodiments of the present teachings can be extended to any material that has periodic filter holes (such as a woven mesh) provided that the addition of a second layer with a different hole pitch will advantageously provide increased tortuosity and a trapping mechanism which is improved over the use of either filter layer by itself.

For a printhead arrangement with a 2D array of actuators, the spatial periodicity of the holes of the combined filter layers which form the filter assembly can be chosen based on a spatial arrangement of the actuators. It may be desirable that a filter assembly hole pattern is uniform throughout the printhead so that the actuators can be placed in a position which avoids the placement of the ink path in the non-ideal filter assembly regions. Therefore, if the spatial frequency of the actuators is "$f_{act}$" actuators per unit length and the spatial frequency of the filter holes in a first filter layer is $f_1$ holes per unit length, then the spatial frequency of filter holes provided in a second filter layer can be $f_1 \pm f_{act}$.

The spatial frequencies can be different in different directions yielding a spatial periodicity $(1/\Delta f)x$ in the X-direction and $(1/\Delta f)y$ in the Y-direction. For simplicity, the examples depicted herein use equal periodicity in the X- and Y-directions.

After formation of a filter assembly that includes at least two filter layers with different pore periodicities, processing can continue to form a completed printhead, wherein the filter assembly is configured for use as a particulate filter (rock screen) for ink during use. Formation of a complete printhead can include the formation of a plurality of ink ports through a diaphragm and the attachment of a plurality of actuators (piezoelectric transducers) to the diaphragm in accordance with some known designs.

Figure 14:
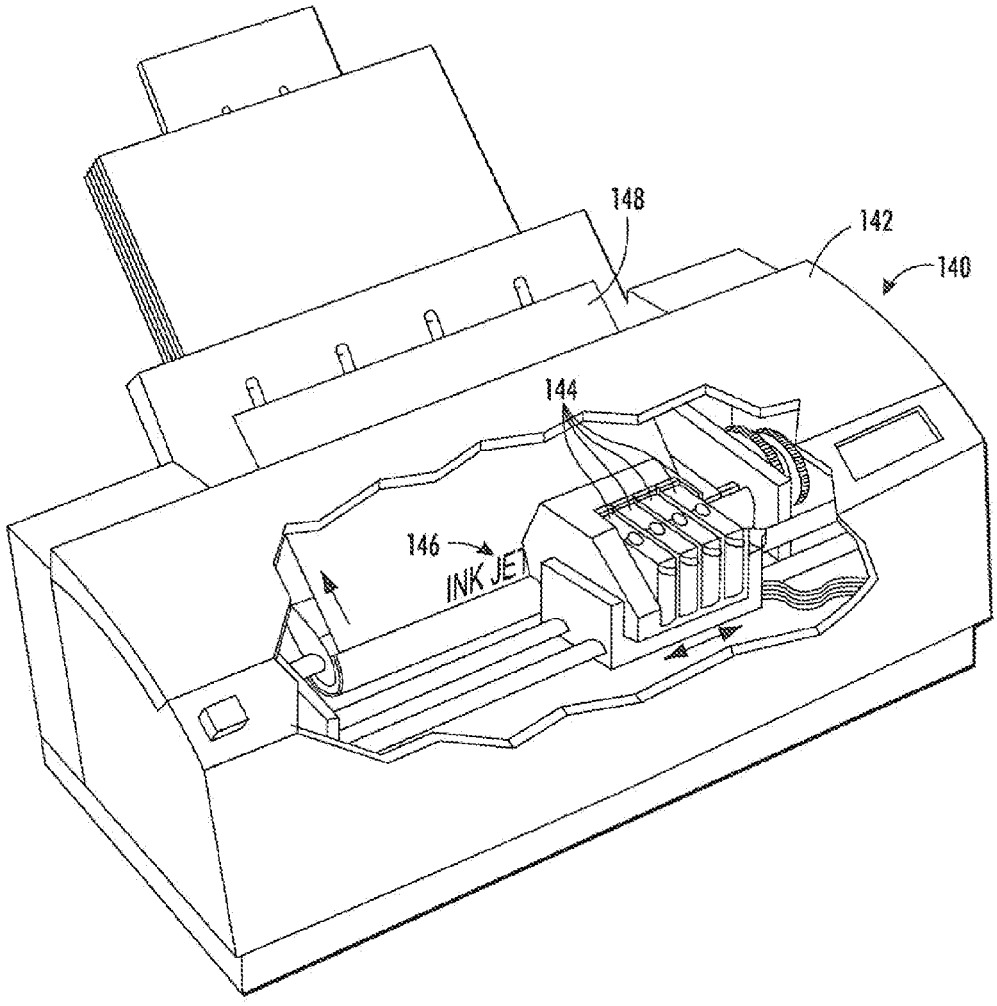
FIG. 14 is a perspective depiction of a printer and printhead in accordance with an embodiment of the present teachings.

FIG. 14 depicts a printer 140 including a printer housing 142 into which at least one printhead 144 including a particulate filter assembly in accordance with the present teachings as discussed above has been installed. During operation of the printer 140, ink 146 is ejected from the one or more printheads 144. Each printhead 144 is operated in accordance with digital instructions to create a desired ink image 146 on a print medium 148 such as a paper sheet, plastic, etc. Each printhead 144 may move back and forth relative to the print medium 148 in a scanning motion to generate the printed image swath by swath. Alternately, each printhead 144 may be held fixed and the print medium 148 moved relative to it, creating an image as wide as the printhead 144 in a single pass. Each printhead 144 can be narrower than, or as wide as, the print medium 148. In another embodiment, each printhead 144 can print to an intermediate surface such as a rotating drum or belt (not depicted for simplicity) for subsequent transfer to a print medium.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a filter assembly or other workpiece, regardless of the orientation of the workpiece. The term "vertical" refers to a direction perpendicular to a plane of the filter assembly or other workpiece. Terms such as "on," "side" (as in "sidewall"), "higher," "lower," "over," "top," and "under" are defined with respect to the conventional plane or working surface being on the top surface of the filter assembly or other workpiece, regardless of the orientation of the filter assembly or workpiece.

The invention claimed is:

1. A structure, comprising:

filter assembly, comprising:

a first filter layer comprising a plurality of pores therein arranged in a pattern, wherein the plurality of pores in the first filter layer comprises a first pore pitch;

a second filter layer adjacent to the first filter layer and comprising a plurality of pores therein arranged in a pattern, wherein the plurality of pores in the second filter layer comprises a second pore pitch which is different than the first pore pitch; and a fluid path through the filter assembly, wherein an area of overlap of the pores in the first filter layer with the pores in the second filter layer, in a vertical direction perpendicular to a plane of the filter assembly, comprises a periodicity defined by the area of overlap of each pore in the first filter layer with one of the pores in the second filter layer across the filter assembly; wherein:

each of the plurality of pores in the first filter layer comprises a taper, wherein a first pore opening at a first surface of the first filter layer is larger than a second pore opening at a second surface of the first filter layer;

each of the plurality of pores in the second filter layer comprises a taper, wherein a first pore opening at a first surface of the second filter layer is larger than a second pore opening at a second surface of the second filter layer; and the plurality of pore openings in the second surface of the first filter layer faces the plurality of pore openings in the second surface of the second filter layer.

2. The structure of claim 1, wherein the structure is an ink jet printhead, the fluid path is an ink path, and the ink jet print head further comprises a plurality of actuators configured to expel ink from the ink jet printhead, wherein a pitch of the plurality of actuators is equal to the periodicity of the overlap of the pores in the first filter layer with the pores in the second filter layer.

3. The structure of claim 1, wherein the filter assembly further comprises:

a plurality of first filter assembly regions within which an area of overlap of each pore in the first filter layer with a pore in the second filter layer is 25% or less; and a plurality of second filter assembly regions within which an area of overlap of each pore in the first filter layer with a pore in the second filter layer is more than 75%.

4. The structure of claim 3, wherein the filter assembly further comprises plurality of third filter assembly regions within which an area of overlap of each pore in the first filter layer with a pore in the second filter layer is more than 25% and less than or equal to 75%.

5. The structure of claim 1, further comprising:

a plurality of first regions within the filter assembly, wherein the plurality of first regions each comprise pores through the filter assembly and the fluid path extends through the plurality of first regions; and a plurality of second regions within the filter assembly, wherein the plurality of second regions each comprise pores through the filter assembly and the fluid path does not extend through the plurality of second regions.

6. The structure of claim 5, wherein the assembly is an ink jet printhead and the assembly further comprises a plurality of actuators configured to expel ink from the ink jet printhead, wherein a pitch of the plurality of actuators is equal to the periodicity of the overlap of the pores in the first filter layer with the pores in the second filter layer, wherein the plurality of actuators overlies one of the plurality of first regions within the filter assembly and the plurality of actuators does not overlie the plurality of second regions within the filter assembly.

7. The structure of claim 5, further comprising a plurality of fluid path elimination structures configured to block the flow of fluid through the plurality of second regions within the filter assembly.

8. The structure of claim 7, wherein the plurality of fluid path elimination structures includes a patterned photosensitive layer interposed between the first filter layer and the second filter layer at the plurality of second regions.

9. The structure of claim 7, wherein the plurality of fluid path elimination structures comprises a melted portion of the first filter layer at the plurality of second regions.

10. The structure of claim 7, wherein the plurality of fluid path elimination structures includes a patterned blocking layer attached to a surface of the first filter layer at the plurality of second regions.

* * * * *